United States Patent [19]

Descotes

[11] 4,277,159

[45] Jul. 7, 1981

[54] PHOTO-PROCESSING DRUM WITH NON-REUSABLE CHEMICALS, FOR USE IN DAYLIGHT CONDITIONS, FOR PROCESSING PHOTO-SENSITIVE SURFACES WITH FLEXIBLE SUPPORTS

[76] Inventor: Maurice J. Descotes, L'Amenokal Rte. de Nages, Langlade, France, 30980

[21] Appl. No.: 76,153

[22] Filed: Sep. 17, 1979

[30] Foreign Application Priority Data

Sep. 18, 1978 [FR] France ..... 78 26649

[51] Int. Cl.[3] ..... G03D 13/04

[52] U.S. Cl. ..... 354/312; 354/330; 366/213

[58] Field of Search ..... 354/312, 313, 315, 323, 354/329, 330; 366/213

[56] References Cited

U.S. PATENT DOCUMENTS

| | | | |
|---|---|---|---|
| 3,693,529 | 9/1972 | Stabler | 354/330 |
| 3,727,535 | 4/1973 | Streeter | 354/329 |
| 3,856,395 | 12/1974 | Comstock | 354/312 |
| 3,864,710 | 2/1975 | Zuber et al. | 354/329 |

FOREIGN PATENT DOCUMENTS

| | | | |
|---|---|---|---|
| 2047864 | 6/1972 | Fed. Rep. of Germany | 354/330 |
| 1549183 | 12/1968 | France | 354/329 |
| 113444 | 12/1966 | Netherlands | 354/329 |
| 1494737 | 12/1977 | United Kingdom | 354/329 |

*Primary Examiner*—L. T. Hix
*Assistant Examiner*—Alan Mathews
*Attorney, Agent, or Firm*—James E. Nilles

[57] ABSTRACT

A photo-processing drum with non-reusable chemicals, for use in daylight conditions, for processing photo-sensitive surfaces with flexible supports, which drum is constituted by two concentric cylinders, closed at one end by the same bottom wall. A flange closes at the other end, a passage provided between the two cylinders and a removable and light-tight cover fits into the free end of the inner cylinder. An axial orifice permits the introduction into the drum of the processing solutions. A slot, made in the wall of the inner cylinder and a joining surface allow the solution contained in the said cylinder to flow into the said passage and to be drained through a draining outlet, when the drum is rotated in one direction. The processing solutions are stirred during the processing step, by rotating the drum in the opposite direction.

12 Claims, 10 Drawing Figures

PHOTO-PROCESSING DRUM WITH NON-REUSABLE CHEMICALS, FOR USE IN DAYLIGHT CONDITIONS, FOR PROCESSING PHOTO-SENSITIVE SURFACES WITH FLEXIBLE SUPPORTS

The present invention relates to a photo-processing drum with non-reusable chemicals, for use in daylight conditions for processing photographic sensitive surfaces or other surfaces with flexible supports, of the type moving in rotation about its horizontal longitudinal axis in a first direction for recurringly dipping the sensitive surface in a processing solution, and in a second reverse direction for draining off the said processing solution from the said drum, and comprising on the one hand, a cylinder-shaped container composed of a cylinder of circular cross-section, of a built-in base wall provided with a central orifice and adapted to seal off the said container from the light, and, on the other hand, a draining passage partly surrounding the said cylinder-shaped container and issueing, at one end, on to the outside by way of an outlet, and at the other end, into a longitudinal slot provided in the cylinder-shaped container.

Drums of this type, known for example from Dutch Pat. No. 113 444, do not make it possible to introduce the different processing solutions through an orifice provided in the centre of the removable cover of the drum and also they show considerable unbalance so that their rotation is irregular and quickly lead to the drum swaying, which is disastrous for a regular processing of photo-sensitive surfaces.

The special design of the drums of the said known type is the reason why the processing solutions come into contact with part of the photo-sensitive surface before the process has actually begun.

In addition, the known drums are not suited for a rapid and easy connection and disconnection, in and from their horizontal position of rotation.

It is the object of the invention to overcome these disadvantages and to propose a drum of the aforesaid type which, except for the introduction of the sensitive surface therein, makes it possible to carry out all the other operations in daylight conditions and without any of the processing chemicals risking to flow accidentally over the sides of the drum.

This object is attained according to the invention due to the fact that the draining passage is delimited by two concentric cylinders of which the inner cylinder is provided with the said longitudinal slot, and the outer cylinder is also provided with a longitudinal cut or opening situated at least approximately between the two identical radial planes passing through the edges of the opening of the inner cylinder and constituting the draining outlet, that a joining wall connects one of the longitudinal edges of the opening of the inner cylinder to the opposite and longitudinal far edge of the opening of the outer cylinder, that the width of the inside opening is such that the radial planes passing through the longitudinal edges of the opening of the inner cylinder include an angle of about 45° and that the central orifice of the removable cover is designed so as to exclude the light and to let in the processing solution into the inner cylinder.

Due to this design, the drum is well balanced in rotation, the processing solution is recurrently and efficiently stirred and the sensitive surface is adequately and uniformly processed. Moreover, the drum is easy to handle, especially from the point of view of the positioning of the sensitive surface and the introduction and draining off of the processing solutions. In addition, for a pre-determined horizontal position of the drum, the processing solution introduced into the drum accumulates in the draining passage and in the opening of the inner cylinder without coming into contact with the sensitive surface before the said drum is set in rotation.

It is a further object of the present invention to design the drum so that it can easily and rapidly be coupled to and uncoupled from a support and driving device.

German Patent Application No. 2 047 864 has already described a processing drum combined with a support means and means for driving it in rotation, of the type comprising a box divided into two parts, one containing a driving mechanism for the processing drum, such as a motor, the other comprising on its base a collecting channel, and above it, the said drum which, in the horizontal position, rests on two support shafts mounted for rotation in bearings, of which shafts the one which is mounted in the wall separating the two parts is hollow and provided with a supply pipe as well as with a driving member connected to the said motor by way of a transmission.

According to this particular technique, the processing drum seems to be permanently installed and not to comprise a built-in cover to allow the introduction of the photo-sensitive surface in the axial direction of the drum.

To overcome these disadvantages and to make the drum easily manoeuvrable before, during and after the processing of the photo-sensitive surfaces, it is proposed according to the invention to further provide the bottom wall, which is fast with the two concentric cylinders, with a recess identical in shape to the recess provided in the cover and which is in line with the longitudinal axis of the drum and of the recess in the cover, and which is also directed towards the inside of the inner cylinder, that each of said recesses is adapted to receive a rotary block fitting with no noticeable clearance inside the corresponding recess so as to transmit to the said drum a rotation torque, the said block comprising a shaft that extends outwardly of the drum and is in line with the longitudinal axis of the said drum, which shaft is mounted to rotate in a corresponding bearing and supports with said bearing the said drum during its rotation, that the shaft of the blocks and of the corresponding bearings are in line together, that the block and its shaft combined with the cover are hollow and traversed by a supply pipe, the end of which projects from the cover pipe, penetrates the capping of the said cover, and that the other block and its bearing are movable and can be moved in the axial direction.

Due to these characteristics, the processing drum is easy to use and to operate.

Other characteristics and advantages of the present invention will become obvious from the claims and also from the following description of an embodiment illustrated in the accompanying drawings in which:

Figure 1:
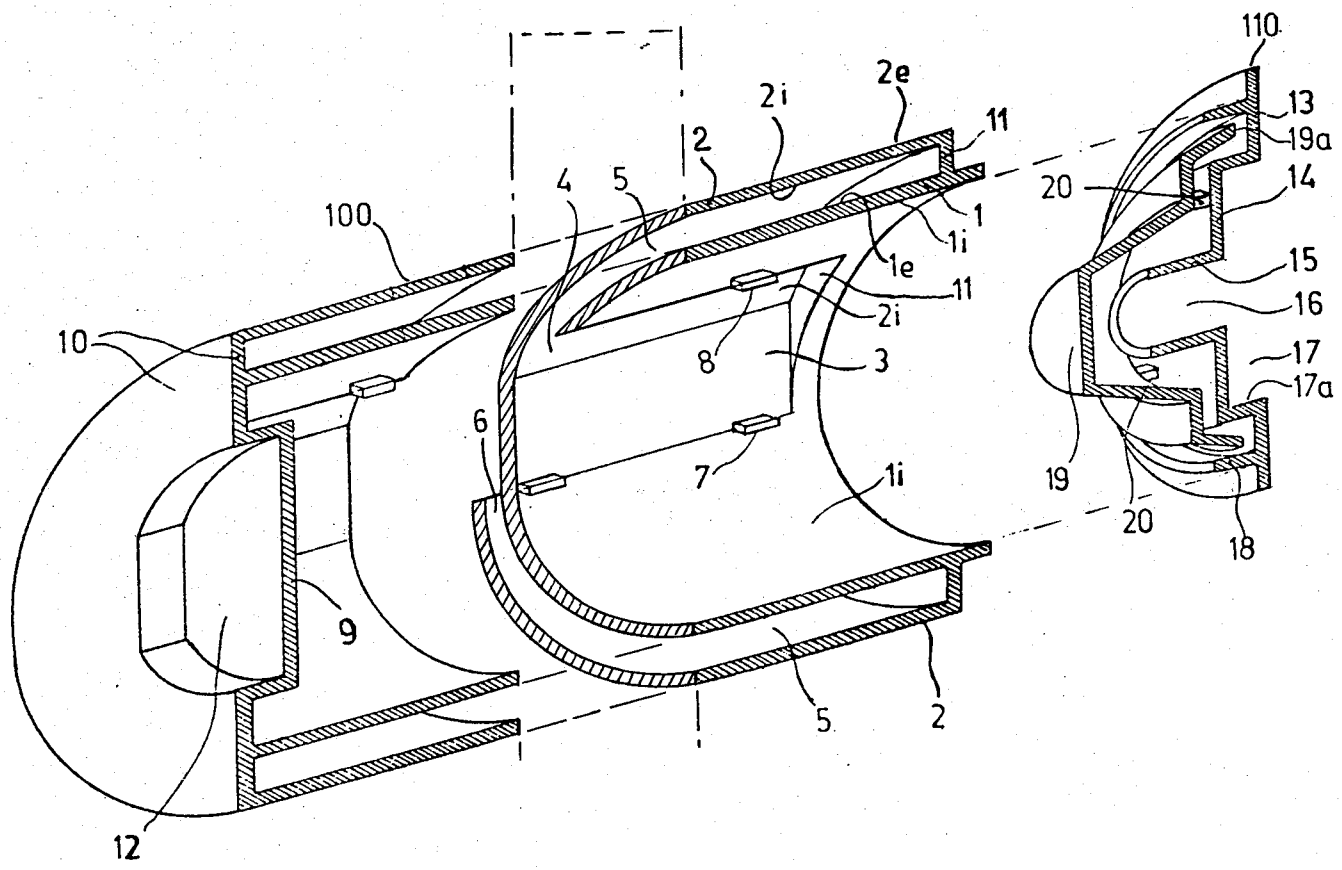
FIG. 1 is an exploded perspective of an axial vertical cross-section of the processing drum and of its removable cover.
Figure 2:
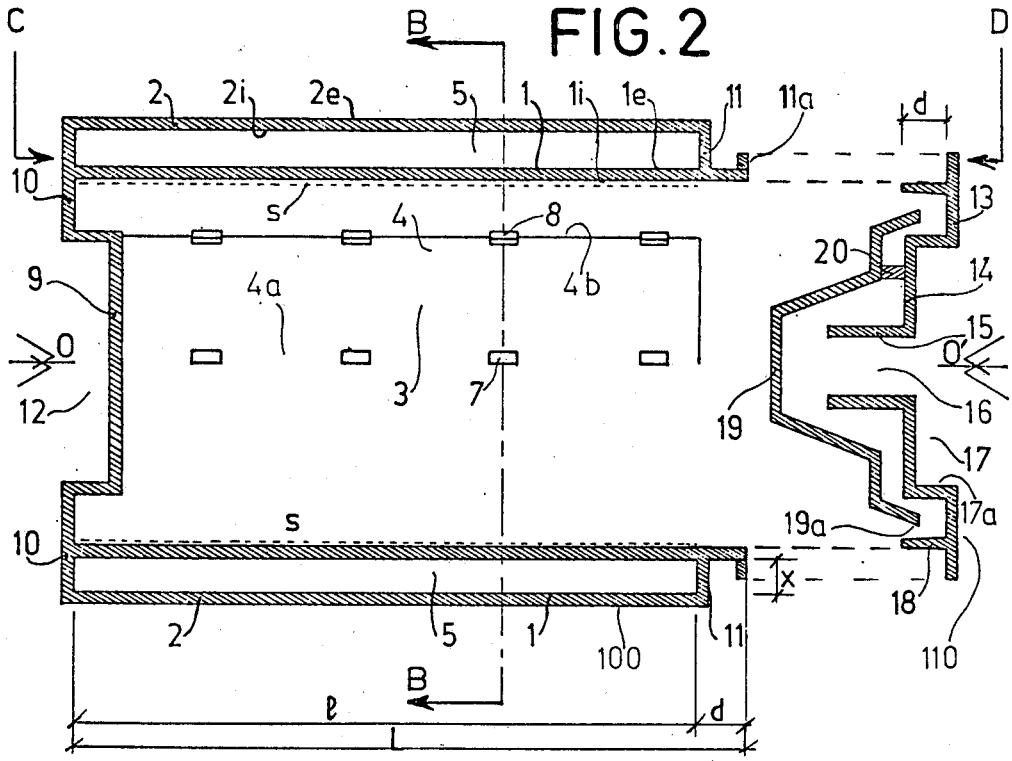
FIG. 2 is a plan view of an axial cross-section through the drum and through its cover along line A—A of FIG. 3.

Such as illustrated in FIGS. 1 to 6 and 9, 10, the processing drum is constituted by a drum body 100 and by its removable cover 110.

The drum body 100 comprises an inner cylinder 1 of diameter $\phi$ 1 and of length L adapted to the dimensions of the sensitive surface S requiring to be processed, and an outer cylinder 2, concentric to the cylinder 1, and of diameter $\phi$ 2 and length 1.

The diameter $\phi$ 2 of the cylinder 2 is greater than the diameter $\phi$ 1 of the cylinder 1 so that a draining passage 5 is created between the outer wall 1*e* of the inner cylinder 1 and the inner wall 2*i* of the outer cylinder 2 and is sufficiently wide to allow the rapid removal of the solutions contained in the cylinder 1.

The length 1 of the cylinder 2 is shorter than the length L of the cylinder 1 by a value d which corresponds to the depth at which the cover sinks into the inner cylinder 1. At the opposite end to the one receiving the cover 110, the cylinders 1 and 2 are tightly sealed by a built-in bottom wall 10, provided with a recess 12 comprising a co-axial side wall 12*a* and a base perpendicular to the longitudinal axis 00' of the drum 100. Said recess 12 is directed inwards of the inner cylinder 1.

The draining passage 5 is necessarily annular and cylindrical in shape and a built-in flange 11 tightly seals its end situated on the side of the cover 110.

The cylinder 1 is open at its end opposite the bottom wall 10, said open end being tightly sealable by means of the removable cover 110.

In parallel to the longitudinal axis 00' of the cylinders 1 and 2, an oblong opening or slot 4 is made in the wall of the inner cylinder 1 over a length l going from the bottom wall 10 to the other end of the outer cylinder 2 thus corresponding to the length thereto. Said slot 4 constitutes the opening by which the draining passage 5 is connected with the inside of the inner cylinder 1.

Said passage 5, delimited by the walls of the inner and outer cylinders 1,2, the bottom wall 10 and the flange 11, issues into the open by an outlet 6 of rectangular cross-section and which is the result of a longitudinal hole or slot 106 cut in the wall of the outer cylinder 2 at least approximately in the radial extension of the edges 4*a*, 4*b* of the inside slot 4.

Figure 3:
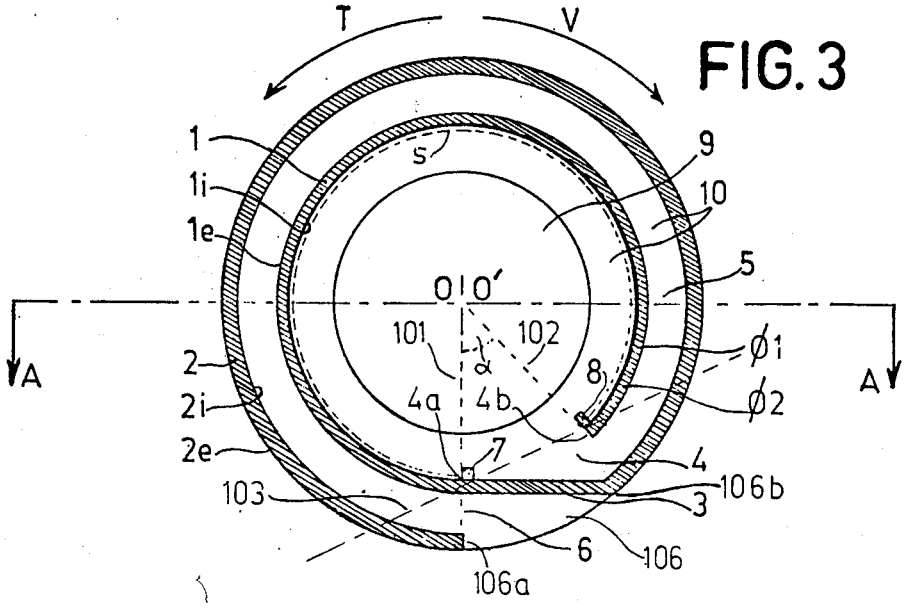
FIG. 3 is an elevation of a vertical cross-section of the processing drum, along line B—B of FIG. 2.
Figure 4:
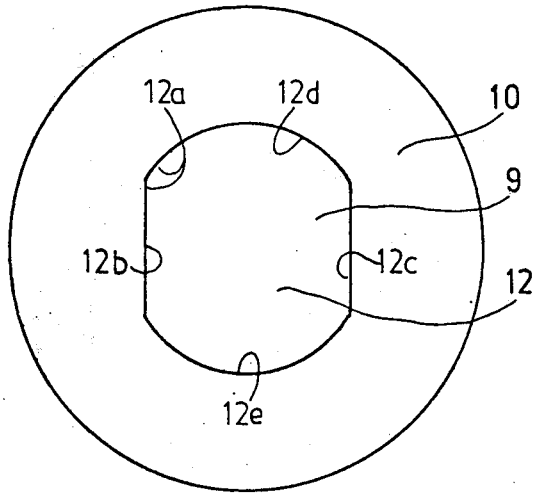
FIG. 4 is an elevation and front view of the bottom wall of the drum, along arrow C of FIG. 2.
Figure 5:
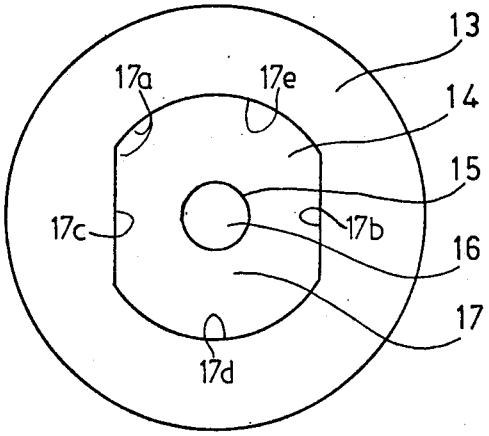
FIG. 5 is an elevation and front view of the cover, along arrow D of FIG. 2.

The cross-sectional width of the inside slot 4 is such that the radial planes 101, 102 crossing the longitudinal edges 4*a*, 4*b* of the opening 4 of the inner cylinder 1 include an angle $\alpha$ of about 45° (FIG. 3). The cross-sectional width of the outside hole or slot 106 is at least approximately equal to and preferably less than that of the inside slot 4. The positions of the two slots 4 and 106 with respect to one another are such that the outside slot 106 is at least approximately between the two radial planes 101, 102 crossing the edges 4*a*, 4*b* of the slot 4 of the inner cylinder 1.

Where the slots 4 and 106 are situated, the inner cylinder 1 is joined to the concentric outer cylinder 2 by means of a joining wall 3 which is plane or slightly incurved and which, preferably, goes tangentially from the edge 4*a* of the inner cylinder 1, to join, in incurved and progressive manner if necessary, the opposite far end 106*b* of the wall of the outer cylinder 2, defining with said wall an obtuse angle. Said joining wall 3 thus ensures a continuity between the inner wall 1*i* of the inner cylinder 1, from one (4*a*) of the longitudinal edges 4*a*, 4*b* of the slot 4, and the inner wall 2*i* of the outer cylinder 2 where the edge 106*b* facing the free end 4*b* of the inside slot 4 is situated.

One (106*a*) of the longitudinal edges 106*a*, 106*b* of the outer slot 106 is situated preferably in the same radial plane 101 as the edge 4*a* of the slot 4, which edge 4*a* is joined to the joining wall 3. The other edge 106*b* is situated between the two radial planes 101 and 102 and could even be situated at the point defined by the intersection of the bisector plane of the radial planes 101 and 102 and the outer cylinder 2. Thus the volume of the bowl defined by the plane 103 crossing through the edges 4*a*, 4*b*, the joining wall and the inner wall 2*i* of the outer cylinder up to the intersection of the latter with the plane 103 may be increased as well as the volume of the processing solution which, in the appropriate position of the drum, in which position the plane 103 is horizontal, will accumulate in the said bowl and will not come into contact with the sensitive surface S before the said tank 100 is set in rotation. It is understood that the difference between the diameters of the two cylinders 1,2 is selected in such a way that the thickness or radial height of the draining passage 5 is sufficient to quickly remove the processing solutions towards the outlet 6.

Due to the mutual disposition of the concentric cylinders 1 and 2, of the slots 4 and 106 and of the joining wall 3, the drum 100 shows virtually no noticeable unbalance.

Where each longitudinal edge 4*a*, 4*b* of the inside slot 4 is situated or adjacent thereto, there is provided, preferably in adjustable manner in the circumferential direction, on the inside wall 1*i* of the inner cylinder 1, a row of lugs 7, 8 regularly spaced out and serving as lateral stop members for holding the sensitive surface S in position inside the inner cylinder 1 against its displacement in one or the other circumferential direction, thereby preventing the slot 4 from becoming sealed off.

The removable cover 100 of the drum 100 comprises an outer wall shaped as an annular disk 13 perpendicular to the axis 00' and provided with a flexible cylindrical flange 18, set back from its edge, and of length d, and fitting very tightly inside the inner cylinder 1. To the inside edge of the annular wall 13 is coupled a co-axial cylindrical side wall 17*a* which defines with the bottom 14, a recess 17 directed inwardly of the inner cylinder 1. The height of the side wall 17*a* and therefore the depth of the recess 17 are substantially equal to the height d of the flange 18. The base 14 of the cover 110 is parallel to the annular wall 13. The shape of this recess 17 is the same as that of the recess 12 in the bottom wall 10 of the drum 100. The side wall 12*a*, 17*a* of each recess 12, 17 comprises two parallel plane faces 12*b*, 12*c* and 17*b*, 17*c* and between the said parallel plane faces, two curved faces, preferably cylindrical, 12*d*, 12*e* and 17*d*, 17*e*. The plane faces 12*b*, 12*c* or 17*b*, 17*c* and the curved faces 12*d*, 12*e* or 17*d*, 17*e* are arranged symmetrically with respect to the axis of the cylindrical recess 12, 17 which is in line with the axis 00' of the drum 100. The pair of plane faces of each recess is meant to come into contact with a member of corresponding shape and to transfer to the drum 100 a rotation torque or movement. A central circular orifice 16 provided in the bottom 14 and extended by a tube 15 directed towards the inside of the inner cylinder 1 will permit the introduction into the said cylinder 1 of the solution necessary to process the sensitive surface S.

The light-tightness of the cover 110 where the orifice 16 is situated is ensured by a truncated cone-shaped capping 19 which tops, at a distance, the tube 15, the side wall 17*a* and the bottom 14 of the recess 17, penetrates by its widened end 19*a* into the annular groove 18*a* defined by the side wall 17*a* and the flange 18 and which is secured to the bottom 14 by spacing discs 20 spaced out so that they allow the passage of the solutions from the top of the capping towards the inside of the inner cylinder 1.

The outside diameter of the annular wall 13 of the cover 113 may vary between the diameters $\phi$ 1 and $\phi$ 2 of the cylinders 1 and 2.

The cover 110 is fitted into the inner cylinder 1 with pressure, the flexibility of the cylindrical flange 18 being such that a slight deformation thereof will ensure that said cover 100 stays firmly on the drum 100 thereby sealing the latter in the drum-cover contact area.

The dimensions of the drum 100 are appropriate to the sizes of the sensitive surfaces S.

For example, for a sensitive surface S of 20×25 cm a suitable drum will have the following dimensions:

| | |
|---|---|
| diameter of cylinder 1 | $\phi$ 1 = 120 mm |
| diameter of cylinder 2 | $\phi$ 2 = 160 mm |
| length of cylinder 1 | L = 225 mm |
| length of cylinder 2 and of slot 4 | 1 = 210 mm |
| sinking depth | d = 15 mm |

For a sensitive surface S of 30×40 cm, a suitable drum will have the following dimensions:

| | |
|---|---|
| diameter of cylinder 1 | $\phi$ 1 = 120 mm |
| diameter of cylinder 2 | $\phi$ 2 = 160 mm |
| length of cylinder 1 | L = 425 mm |
| length of cylinder 2 and of slot 4 | 1 = 410 mm |
| sinking depth | d = 15 mm |

For a sensitive surface S of 50×60 cm, a suitable drum will have the following dimensions:

| | |
|---|---|
| diameter of cylinder 1 | $\phi$ 1 = 200 mm |
| diameter of cylinder 2 | $\phi$ 2 = 250 mm |
| length of cylinder 1 | L = 630 mm |
| length of cylinder 2 and of slot 4 | 1 = 610 mm |
| sinking depth | d = 20 mm. |

These dimensions are given by way of example, and the diameters and lengths may vary substantially around the values indicated above.

The important thing however is for the difference between the diameters $\phi$ 1 and $\phi$ 2 to be sufficient to rapidly drain off the processing solutions whilst keeping the inner cylinder sealed against the light. The material used for the drum will be as light as possible and resistant to any corroding by the processing chemicals. Plastics are particularly suitable to produce the drums.

The walls of the cylinders will be as thin as possible in order to give a light and perfectly rigid drum.

Figure 6:
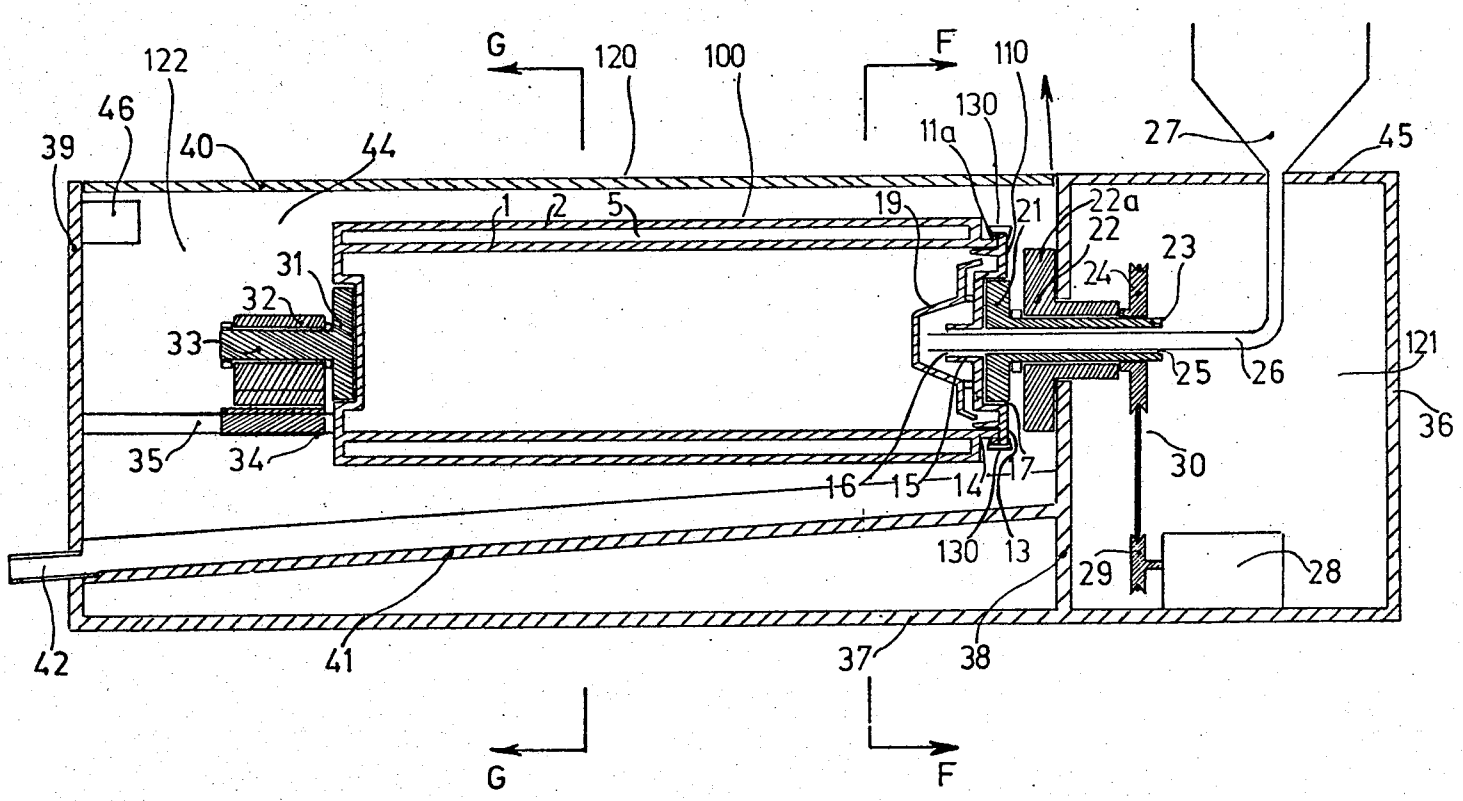
FIG. 6 is an axial vertical cross-section of the processing drum fitted on its support and driving device, along line E—E of FIGS. 7 and 8.
Figure 7:
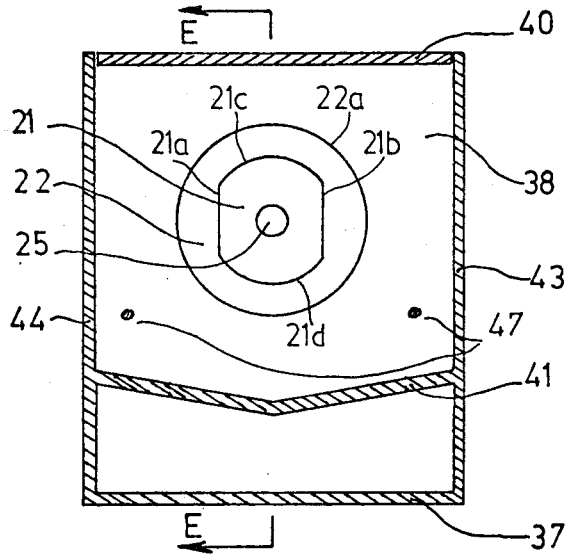
FIG. 7 is a side view of a vertical cross-section of the support and driving device along line F—F of FIG. 6, the drum having been omitted for clarity.
Figure 8:
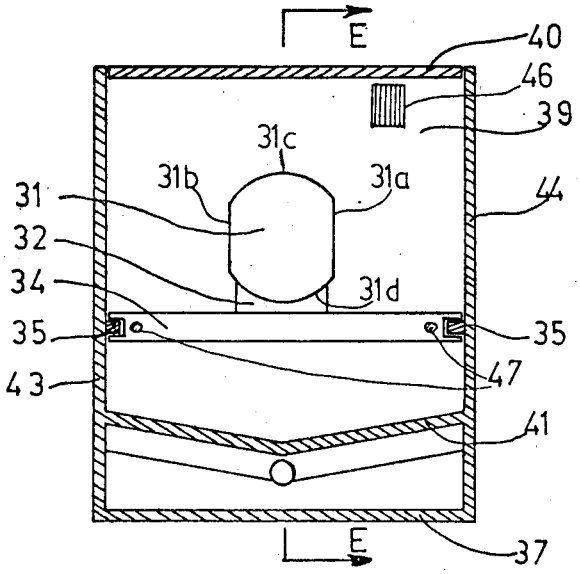
FIG. 8 is a side view of another vertical cross-section of the support and driving device, along line G—G of FIG. 6, the drum having been omitted for clarity.

FIGS. 6 to 8 show that the device for supporting the drum 100 and for driving it in rotation consists in a parallellepipedic box 120 which is divided into two parts 121, 122 separated from each other in sealed manner by a partition wall 38, one part (121) being provided with a mechanism such as a motor 28 for driving the drum 100, whilst the other (122) is provided at the bottom with a collecting channel 41, and above the latter, with the said drum 100. The box 120 is made from a corrosion-resistant material and comprises different vertical and horizontal, longitudinal and transversal walls, indicated in FIGS. 6, 7, 8 by the references 36 to 45. The said support and driving mechanism further comprises two slide blocks 21 and 31 the periphery of which is such that they can fit in one of the two recesses 17, 12 of the drum 100 without noticeable side clearance, said blocks 21, 31 being situated co-axially in the part 122 which receives the drum 100. The periphery of each block 21, 31 is thus provided with a pair of parallel plane side faces 21*a*, 21*b* or 31*a*, 31*b* and two curved, preferably cylindrical, faces 21*c*, 21*d* or 31*c*, 31*d*, each of which connects the corresponding ends of two parallel plane faces 21*a*, 21*b* or 31*a*, 31*b*. The plane faces 21*a*, 21*b* or 31*a*, 31*b* and the curved side faces 21*c*, 21*d* or 31*c*, 31*d* of each support and driving block 21, 31 are arranged in symmetrical manner with respect to the aligned axes of the blocks 21, 31, said axes being also aligned with the axis of the drum 100 when in the horizontal position (FIG. 6). Due to this particular conformation of the blocks 21, 31 and of the recesses 12, 17 of the bottom wall 10 and of the cover 110 of the drum 100, the coupling or uncoupling of the latter to and from its support and driving device becomes an easy operation. Thus the rotation movement or torque can be transmitted to the drum 100 without any difficulties.

Outwardly from the drum 100, each block 21, 31 is provided with a support shaft or shaft end 23, 33 which is co-axial to the corresponding block and is mounted in a bearing 22 or 32.

The bearing 22 supporting the shaft 23 of the block 21 associated to the cover 110 of the drum 100 is clamped and secured to the partition wall 38 so that it is partly (collar 22*a*) inside the part 122 of the drum 100 and partly inside the part 121 containing the motor 28.

The shaft 23 and the block 21 are provided in their centre with a cylindrical bore 25 through which can pass an elbow supply pipe 26 connected to a funnel 27 fitted on the cover 45 of the part 121. The length of the supply pipe is such that its free front end passes through the orifice 16 and the tube 15 of the cover 110 and into the capping as far as about five millimeters from the bottom thereof.

The free end of the hollow shaft 23 of the block 21 projects from its bearing 22 and penetrates the part 121 containing the motor 28.

A grooved pulley (or a sprocket wheel) 24 is keyed on the free end of the hollow shaft 23 and is connected via a transmission such as a belt (or the like) 30 and another pulley 29 to the electric motor 28 or to a crank which will permit to rotate the drum 100 in the direction T or in the reverse direction V (FIG. 3).

The other end, namely the bottom wall 10 of the drum 100 is supported by the block 31 whose side outline fits without any noticeable clearance in the recess 12 of the bottom wall 10. The rear face of the block 31 is fast with the shaft end 33 rotating freely in the bearing 32 mounted on a movable support 34. Said movable support 34 is adjustable in axial position and can move in the longitudinal direction of the drum 100 on two horizontal slides 35 fitted on the longitudinal walls 43 and 44 of the box 120. The support 34 of the bearing 32 is adjusted and held in a position where the block 21 is maintained inside the recess 17 of the cover 110.

One or more return springs 47 can also be used in order to urge the support 34 with the bearing 32 and its block 31 permanently towards the partition 38 and the other block 31. Two springs 47 are fitted, to this end, on the movable support 34 and on the partition wall 38.

The drum 100 is set and held in the horizontal position between the blocks 21 and 31 sunk in the recesses 17 and 12 of the removable cover 110 and of the bottom wall 10 of the said drum 100 and the return springs 47 of the movable support 34 prevent the said drum from releasing itself from its support blocks 21, 31 during operation, whilst keeping the cover 110 tightly sealed on the drum.

The bowl receiving the waste products is constituted by the inclined channel 41 discharging outwardly through the pipe 42 (for example towards a draining sink) the processing solutions flowing from the drum 100 through the outlet 6.

The cover 40 closes the part 122 of the box 120 and a blower with incorporated thermostat 46 will produce a hot air bath at one degree more or less than what is needed to keep the inside of the box at the desired temperature.

The dimensions of the box 120 are determined in relation to the largest drum selected for use. All drums of smaller dimensions can be used due to the axial mobility of the block 31 and of its bearing 32.

For example, when using a box capable of receiving a drum for processing a sensitive surface S of 50×60 cm, said box can also be used for treating any other smaller sizes in appropriate drums, since the movable bearing 32 is constantly urged by the springs 47 towards the fixed bearing 22 until the block 31 contacts the bottom 9 of the recess 12.

Only the recesses 17 and 12 and the blocks 21 and 31 will need to be identical for all the drums as well as the diameter of the central orifice 16 of the cover 110.

The open end of the inner cylinder 1 may be provided with a flange 11*a* against which can apply the outer part of the outside wall 13 of the cover 110. This way, the cover 110 can be made mechanically integral with the body of the drum 100 by way of removable clips, of the paper clips type, covering the edges of the flange 11*a* and of the outside wall 13 (see FIGS. 2 and 6).

The processing drum described is cylinder-shaped and its cross-section has the general appearance of an open curve doing nearly two revolutions about the longitudinal axis of the drum ahd comprising two concentric circular portions each of which covers substantially the same circular sector whose radii include an angle of the order of 300 to 320 degrees, the inside circular portion being connected to the outside circular portion by a straight or slightly incurved line starting tangentially from the inside portion. There is thus a continuity along a transverse section of the inner surface 1*i* and 2*i* of the cylinders 1 and 2, from the row of aligned lugs 8 to the outlet 6. The use of the drum is deduced from this peculiarity.

After the introduction in darkness of the sensitive surface S into the drum 100 and fitting the cover 110 to ensure light-tightness, then it is possible to operate in daylight.

The sealed drum is placed on the driving device (FIG. 6) between the blocks 21 and 31 which fit in the recesses 17 and 12.

Figure 9:
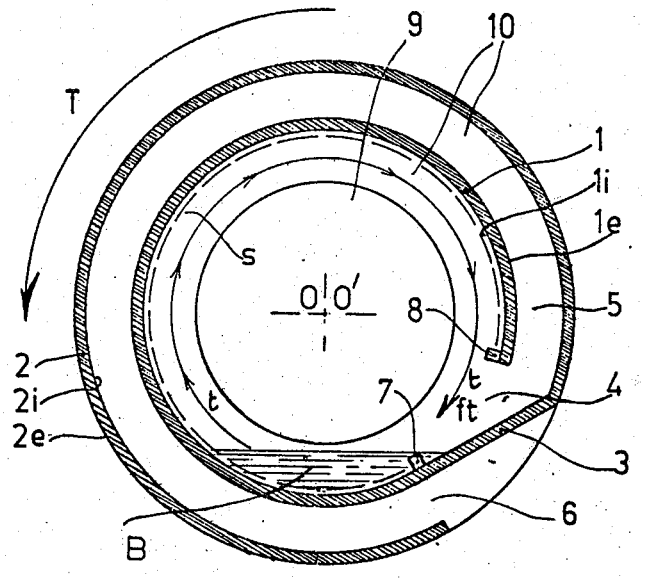
FIGS. 9 and 10 are elevations of two cross-sections of the axis of the drum showing it in two different working positions.
Figure 10:
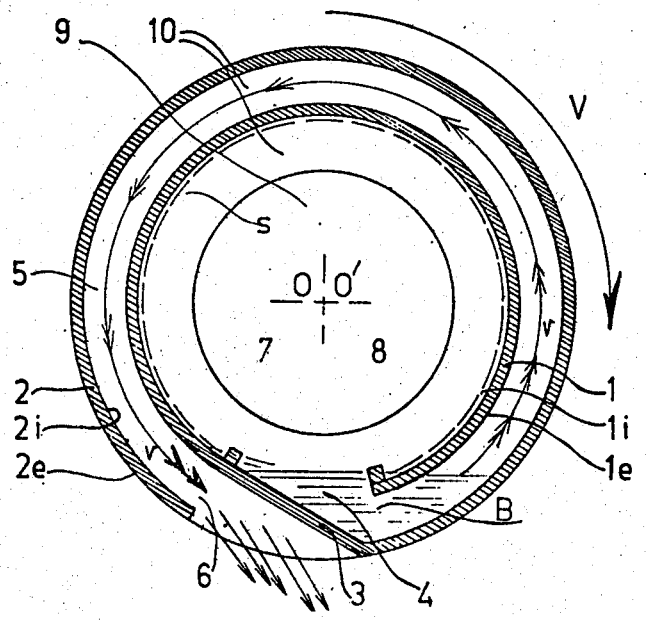

The drum is rotated in the direction T (FIG. 9).

The processing solution is introduced in just the right quantity for the size of the sensitive surface S via the funnel 27. Said solution flows into the tank via the supply pipe 26, through the orifice 16 and down along the capping 19 into the bowl delimited in the horizontal position from the rows of lugs 7, 8 the slot 4 and the part adjoining the passage 5 without the sensitive surface S being moistened.

When pivoting the drum in the direction T (FIG. 9), the apparent displacement of the processing bath B on the sensitive surface S is in the direction of arrows t. At each rotation, the break caused by the free end 4*b* of the slot 4 causes the bath B to stir. The lugs 8 act as stop members and prevent the sensitive surface S from being driven away by the movement of the liquid when the said drum 100 is rotated in the direction T.

At the end of the period prescribed for processing the sensitive surface S with the processing bath B, the drum 100 is rotated in reverse in the direction V. The apparent displacement of the bath B is then in the direction of arrows v (see FIG. 10). Said bath B flows into the passage 5 through the slot 4 until it is drained through the outlet 6 into the channel 41 (FIGS. 6,7,8). The lugs or stop members 7 prevent the sensitive surface S from being driven away by the draining bath, when the drum rotates in the opposite direction, namely in the direction of arrow V.

The draining off will be quick and total because of the dimensions of the slot 4 and of the passage 5.

This method will be used for each processing bath used.

For an intensive wash of the processed sensitive surface S, a strong flow of the washing water will be introduced through the funnel 27 and the supply pipe 26 and into the orifice 16 of the cover 110.

By rotating the drum in the direction V, the sensitive surface S will be washed with constantly renewed water, since each rotation will cause the draining off of the polluted water through the slot 4, the passage 5 and the outlet 6.

The lugs 7 prevent the sensitive surface S from being driven away with the drained water.

When the drum 100 and the sensitive surface S are removed, there will be no risk for the operator of receiving or of coming into contact with drops of the corrosive product.

For processings where the temperature should be rigourously accurate, a hot air blower 46, complete with thermostat, incorporated to the tank supporting and driving device, will permit to keep the drum in an air bath at a temperature differing by more or less one degree from the ideal bath temperature.

When rotating the drum in the direction T, the air will flow into the passage 5 through the orifice 6 and into the cylinder 1 through the slot 4, which will keep the inside of the drum at the temperature of the air inside the device. The processing bath will therefore remain, in view of the volume used and even in small quantities, at the ideal working temperature. If necessary the sensitive surface S can be heated by introducing into the inner cylinder, before any processing bath, a certain volume of water at the processing temperature.

The drum and its driving mechanism have been designed for processing, in non-reusable chemicals and in daylight conditions, photo-sensitive surfaces with flexible supports, intended for black and white and any type of color reproductions. The invention may be used by amateur or professional photographers in the medical and industrial fields to process flexible plane films exposed to active radiations such as X-rays.

The easy use and the simplicity of the system will enable amateur photographers to conduct their own processing without any risks of burns, errors or pollution from the chemicals.

What is claimed is:

1. A photo-processing drum with non-reusable chemicals for use in daylight conditions for processing photographic sensitive surfaces, of the type moving in rotation about its horizontal longitudinal axis in a first direction for recurringly dipping the sensitive surface in a processing solution, and in a second reverse direction for draining off the said processing solution from the said drum, and comprising:

an inner cylinder having two ends, a longitudinal axis, and a wall of circular cross-section, a slot provided in the wall of said inner cylinder and having longitudinal edges defining with the axis of said inner cylinder two radial planes oriented at an angle of about 45° with respect to each other, an outer cylinder having two ends and a diameter greater than the one of said inner cylinder and being disposed concentrically around said inner cylinder, a built-in bottom wall tightly sealing one of the ends of said inner and outer cylinders, a removable cover adapted to tightly seal off the end of said inner and outer cylinders, a removable cover adapted to tightly seal off the end of said inner cylinder opposite to its bottom wall, a longitudinal slot cut in the wall of said outer cylinder, having two longitudinal edges and being positioned with respect to the slot of said inner cylinder so that the slot of said outer cylinder is situated at least approximately between the said two radial planes, a joining wall connecting one of said longitudinal edges of the slot of said inner cylinder to the opposite far edge of the slot of said outer cylinder, and an annular draining passage delimited by said two concentric inner and outer cylinders, by said joining wall, by said bottom wall and by a built-in flange tightly sealing the end of said annular draining passage which faces said removable cover, the slot of the said outer cylinder forming an outlet for said draining passage.

2. A processing drum as claimed in claim 1, wherein the removable cover sinks to a certain depth into the inner cylinder and the outer cylinder is shorter than the inner cylinder, so that there is a difference in length between the inner and the outer cylinder, said difference being preferably equal to the depth at which the removable cover sinks into the inner cylinder.

3. A processing drum as claimed in claim 1, comprising a plurality of stop members for holding the sensitive surface in position, wherein the said stop members are constituted by two longitudinal rows of lugs, the lugs of each row being regularly spaced from one another and mounted on the inside face of the inner cylinder adjacent to the longitudinal edges of the slot of said inner cylinder.

4. A processing drum as claimed in claim 1, wherein the joining wall is tangentially connected to one edge of the slot of the inner cylinder and to the opposite far edge of the slot of the outer cylinder, said joining wall forming an obtuse angle with the outer cylinder.

5. A processing drum as claimed in claim 1, in combination with a device for supporting the said drum and driving it into rotation of the type comprising a box divided into two parts, one containing a driving mechanism, the other comprising on its base a collecting channel, wherein the bottom wall which is fastened to the two concentric inner and outer cylinders further comprises a recess and the removable cover also comprises a recess, said two recesses being identical in shape and in line with the longitudinal axis of the drum and directed towards the inside of the inner cylinder, wherein the said recesses are adapted to receive each a first and second rotary block fitting with no noticeable side clearance inside the corresponding recess so as to transmit to the said drum a rotation torque, said first and second block each comprising a shaft that extends outwardly of the drum and is in line with the longitudinal axis of the said drum, each of said shafts being mounted to rotate in a corresponding bearing mounted in said box, and together with the latter supporting the said drum during its rotation, wherein the said shafts of the blocks and of the corresponding bearings are in line together, and wherein said second block and its bearing associated to the bottom wall of said drum are movable on a movable support and can be moved in the axial direction.

6. A processing drum as claimed in claim 5 wherein the position of said first block is axially immobilized whilst the position of said second block is adjustable in the axial direction of its bearing.

7. A processing drum as claimed in claim 5, wherein the movable bearing mounted on said movable support is axially guided by horizontal guides fixed on the side walls of the said box.

8. A processing drum as claimed in claim 5 wherein said bearing movable on said movable support is permanently urged in the direction of the other bearing fixedly mounted in a partition wall of the said box.

9. A processing drum as claimed in claim 6, wherein a driving member is fixed on the axis of said axially immobilized first block and is connected by a transmission to the driving mechanism, said driving member and transmission being mounted in the same part of the box as said driving mechanism.

10. A processing drum as claimed in claim 1, wherein the removable cover has a central orifice adapted to be light-tight, but to permit the introduction of processing solutions into the inner cylinder.

11. A processing drum as claimed in claim 1, wherein the removable cover has a recess directed inwardly of the inner cylinder, said recess having a bottom provided with a central orifice fitted with a projecting tube extending towards the inside of said inner cylinder, said tube and recess being covered by a capping fixed to said recess bottom by spacing discs.

12. A processing drum as claimed in claim 5, wherein the rotating block and its shaft associated with the removable cover are both provided with a cylinder bore through which passes a supply pipe.

* * * * *